US009651264B2

(12) United States Patent
Husted

(10) Patent No.: US 9,651,264 B2
(45) Date of Patent: May 16, 2017

(54) BRICK ASSEMBLY WITH MAGNETIC ATTACHMENT, AND METHODS OF MAKING AND USE THEREOF

(75) Inventors: Martin D. Husted, Glendora, CA (US); Mark Klein, legal representative, San Clemente, CA (US)

(73) Assignee: Innovative Hearth Products, LLC, Nashville, TN (US)

( * ) Notice: Subject to any disclaimer, the term of this patent is extended or adjusted under 35 U.S.C. 154(b) by 2301 days.

(21) Appl. No.: 12/501,346

(22) Filed: Jul. 10, 2009

(65) Prior Publication Data

US 2010/0095953 A1 Apr. 22, 2010

Related U.S. Application Data

(60) Provisional application No. 61/106,046, filed on Oct. 16, 2008.

(51) Int. Cl.
*F24B 1/18* (2006.01)
*F24B 1/191* (2006.01)

(52) U.S. Cl.
CPC ..... *F24B 1/18* (2013.01); *F24B 1/191* (2013.01)

(58) Field of Classification Search
USPC ..... 126/500; 52/596; 392/347, 348
See application file for complete search history.

(56) References Cited

U.S. PATENT DOCUMENTS

| | | | | |
|---|---|---|---|---|
| 2,429,748 | A * | 10/1947 | Dollinger | 126/521 |
| 4,026,086 | A * | 5/1977 | Langley | 52/592.6 |
| 4,027,711 | A * | 6/1977 | Tummarello | 411/172 |
| 4,338,913 | A * | 7/1982 | Good | 126/77 |
| 6,592,961 | B1 * | 7/2003 | Ruud et al. | 428/99 |
| 2008/0013931 | A1 * | 1/2008 | Bourne | 392/348 |

* cited by examiner

*Primary Examiner* — Kenneth Rinehart
(74) *Attorney, Agent, or Firm* — Arent Fox LLP

(57) ABSTRACT

A brick assembly may include a molded brick having a planar surface and at least one magnetic attachment for magnetically securing the brick assembly to a ferromagnetic surface. A mold assembly for manufacturing a brick assembly may include a mold chamber and at least one magnetic attachment seat or a hinged metal door. A method for manufacturing a brick assembly may include using a mold assembly, a mold material, and at least one magnetic attachment.

3 Claims, 5 Drawing Sheets

BRICK ASSEMBLY WITH MAGNETIC ATTACHMENT, AND METHODS OF MAKING AND USE THEREOF

The patent application claims priority to and herein incorporates by reference Provisional Patent Application No. 61/106,046, entitled "Brick Assembly with Magnetic Attachment, and Methods of Making and Use Thereof" and filed on Oct. 16, 2008.

BACKGROUND

Field

The disclosure relates to the field of hearth products, and, in particular, to a brick assembly with magnetic attachments for affixing the brick assembly to other mechanical parts or assemblies, and methods of making and use thereof.

Background

Hearth products are commonly used to simulate the look and feel of a wood-burning fire without the difficulties and maintenance typically associated with burning solid fuels. The hearth products industry continuously strives to improve the realistic appearance and function of these products.

Hearth products may commonly include a firebox or fireplace insert that is comprised of, or lined with, metal, for example. To give the firebox a more natural, clean and realistic appearance, the perimeter of the firebox opening may be lined with bricks or brick-like devices.

A challenge exists to design and efficiently manufacture aesthetically pleasing hearth accessories that create the realistic appearance of a firebox brick liner that can be safely and efficiently installed, or removed and replaced during routine or emergency maintenance.

SUMMARY

In one aspect of the disclosure, a brick assembly may include a molded brick having a planar surface and at least one magnetic attachment embedded in the molded brick.

In another aspect of the disclosure, a mold assembly for manufacturing a brick assembly may include a mold chamber having a planar side and at least one magnetic attachment seat embedded in the mold assembly.

In another aspect of the disclosure, a mold assembly for manufacturing a brick assembly may include a mold chamber having at least one lateral side, a hinged metal door, and means for securing the hinged metal door against the lateral side of the mold chamber.

In another aspect of the disclosure, a firebox assembly may include a firebox having an interior surface, and at least one molded brick assembly having a planar surface and at least one embedded magnetic attachment, wherein the embedded magnetic attachment magnetically secures the planar surface to the interior surface of the firebox.

In another aspect of the disclosure, a method of manufacturing a brick assembly using a mold assembly, a mold material, and at least one magnetic attachment, includes magnetically securing the magnetic attachment to the embedded magnetic attachment seat, pouring the mold material into the mold chamber, and removing the brick assembly from the mold assembly once the mold material sets.

In another aspect of the disclosure, a method of manufacturing a brick assembly using a mold assembly, a mold material, and at least one magnetic attachment, includes magnetically attaching the magnetic attachment to the hinged metal door, securing the hinged metal door against a lateral side of the mold chamber, pouring the mold material into the mold chamber, releasing the means securing the hinged metal door against the lateral side of the mold chamber once the mold material sets, opening the hinged metal door away from the mold chamber, and removing the brick assembly magnetically attached to the hinged metal door by sliding the brick assembly off of the hinged metal door.

It is understood that other aspects of the invention will become readily apparent to those skilled in the art from the following detailed description, wherein it is shown and described only various aspects of the invention by way of illustration. As will be realized, the invention is capable of other and different configurations and its several details are capable of modification in various other respects, all without departing from the scope of the invention. Accordingly, the drawings and detailed description are to be regarded as illustrative in nature and not as restrictive.

BRIEF DESCRIPTION OF DRAWINGS

Various aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

In the following detailed description, various concepts will be described in the context of a brick with magnetic attachments for installation in a gas fireplace that simulates the look and feel of a natural hearth fireplace. While these concepts are well suited for this application, those skilled in the art will readily appreciate that the bricks with magnetic attachments may also be used with other hearth products, including by way of example, and without limitation, stoves, heaters, furnaces, outdoor fire products, water heating products, barbeque and grilling products, and the like. A hearth, as referred to herein, is the floor surface of any area suitable for a fire, either real or simulated. A hearth is typically made of brick or stone, but a hearth may be comprised of any material suitable for supporting a fire, including cast iron or concrete, for example. And although referred to as bricks, those skilled in the art will readily appreciate that the present invention could also resemble any variety of stones, blocks, or other suitable material for the purposes of creating a more realistic appearance in a masonry environment. Accordingly, any reference to bricks with magnetic attachments for installation in a metal firebox is intended only to illustrate these concepts, with the understanding that such concepts have a wide range of applications.

Figure 1A:
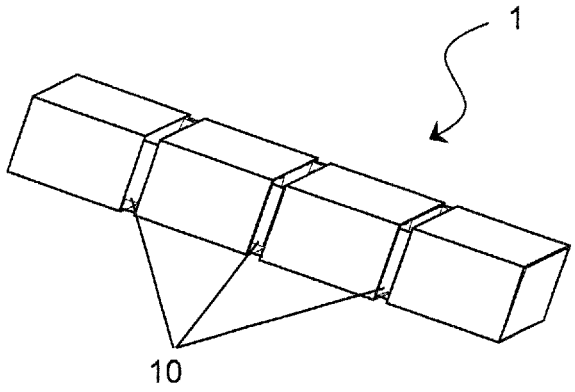
FIGS. 1A and 1B shows different views of a brick assembly with magnetic attachments.
Figure 1B:
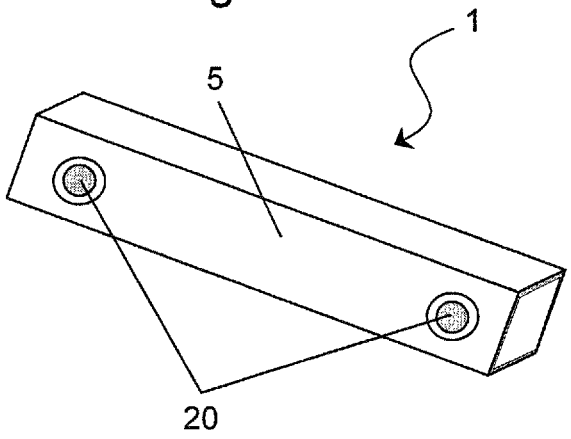

FIGS. 1A and 1B illustrate a brick assembly 1 with magnetic attachments 20. The brick assembly 1 is a whole unit and may be patterned with grout lines 10 to provide the appearance of multiple stacked or joined bricks, for example. The brick assembly 1 may be painted to create a more natural aesthetic. FIG. 1A shows that the grout lines 10 may be formed on at least two molded surfaces of the brick assembly 1. FIG. 1B shows that the magnetic attachments 20 may be embedded in the brick assembly 1 to be flush with a smooth non-molded surface 5 of the brick assembly 1. The number of magnetic attachments 20 may vary and the magnetic attachments 20 may be positioned in any arrangement. It is preferred that magnetic attachments 20 be positioned at least in proximity to the ends of the brick assembly 1 to create enhanced stability and support when the brick is magnetically secured to a metal surface.

Figure 2:
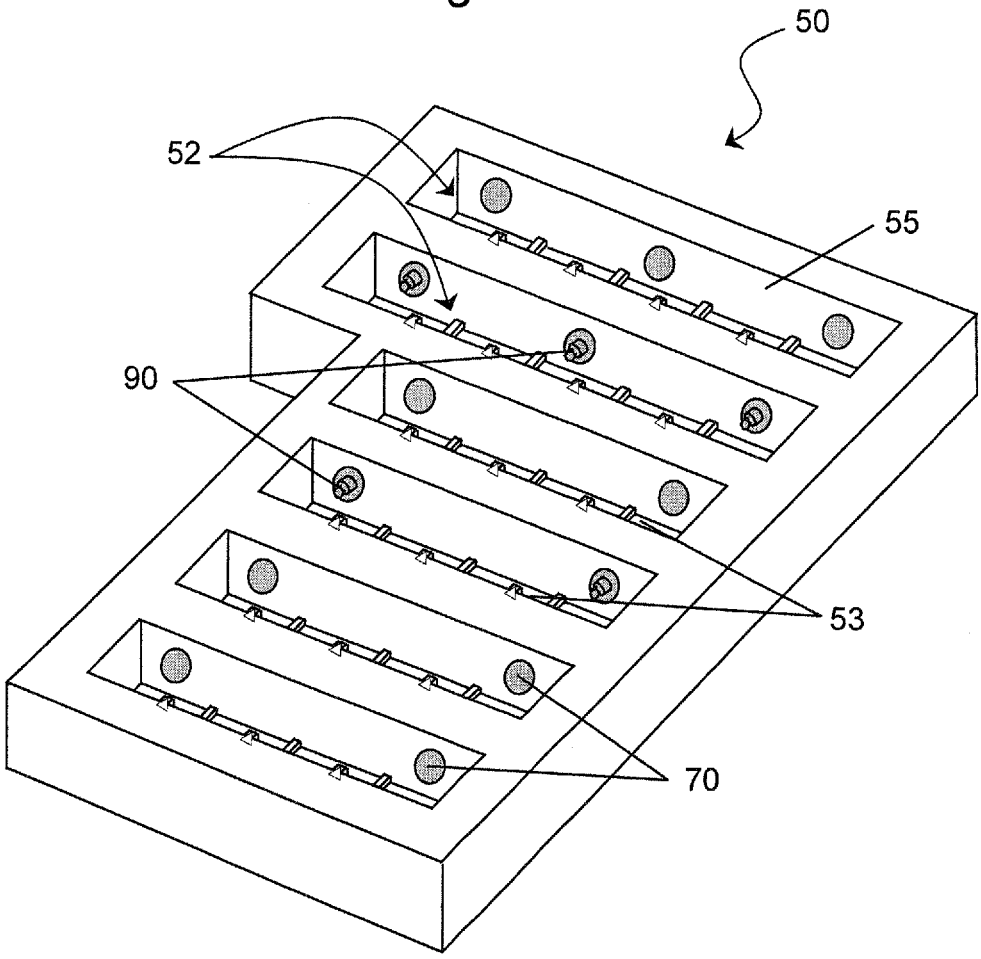
FIG. 2 illustrates a brick mold having multiple mold chambers with multiple magnetic attachment seats.

FIG. 2 shows an exemplary brick mold 50 for forming the brick assemblies 1. The brick mold 50 may have multiple mold chambers 52 for receiving the mold material that will comprise the brick. The mold material may be refractory cement or any other suitable material, or combination of materials, which can be deposited into the mold chambers 52 to set and harden to a solid, including plastics, glass, metals, sand, ceramics or ceramic vapors. Any number of mold chambers 52 may comprise one mold 50 and the individual mold chambers 52 may be of varied dimensions.

Figure 2A:
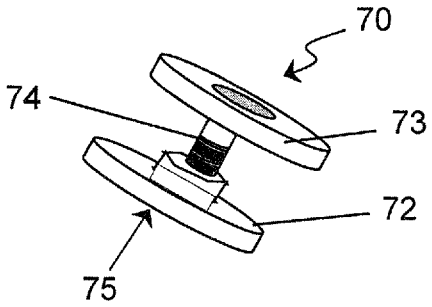
FIG. 2A illustrates an enlarged view of a magnetic attachment seat.

As shown in FIG. 2, an individual mold chamber 52 may be a hollowed rectangular chamber with one open side for pouring the mold material into the mold chamber 52. The mold chamber 52 may have textured surfaces 53 for creating the appearance of grout lines 10, for example, on a finished brick assembly 1. At least one smooth side 55 of the mold chamber 52 may be embedded with magnetic attachment seats 70 that sit flush with the level plane of the smooth side 55. As shown in FIG. 2A, the magnetic attachment seat 70 may comprise a seat disc 72 connected to a seat anchor 73 by a threaded seat post 74, for example. The mold 50 may be formed so that the magnetic attachment seats 70 are embedded orthogonally to the longitudinal dimension of the smooth side 55. A flat surface 75 of the seat disc 72 sits flush with the smooth side 55 in a level plane. The seat anchors 73 prevent the embedded magnetic attachment seats 70 from pulling away from the smooth side 55 of the mold chamber 52, thus ensuring at least one smooth non-molded surface 5 (see FIG. 1B) of the brick assembly 1 may be formed. The magnetic attachment seats 70 are composed of iron or steel, for example, but may be composed of any suitable ferromagnetic material.

The mold 50 may be formed by creating plaster models (not shown) of the different brick types to be molded. For example, one mold 50 may be formed with three left side bricks and three right side bricks that are mirror images of the left side bricks. In this way, entire sets of brick assemblies 1 for a single firebox unit, for example, may be manufactured in one custom designed mold. The magnetic attachment seats 70 may be lightly bonded to the plaster models in predetermined locations to coincide with the positioning of the magnetic attachment seats 70 within the mold chambers 52. A frame (not shown) may be placed around the plaster models and a polyurethane rubber, for example, may be poured over the plaster models to fill the frame. The rubber mold 50 may dry and the plaster models pulled off. Pulling the plaster models off breaks the light bond between the magnetic attachment seats 70 and the plaster models, leaving the magnetic attachment seats 70 embedded in the mold at the exact predetermined locations.

Figure 2B:
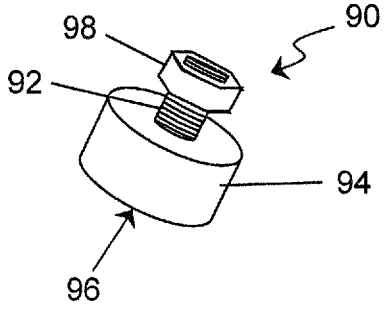
FIG. 2B illustrates an enlarged view of a magnetic attachment.

FIG. 2 shows that magnetic attachments 90 may be secured in the mold chamber 52 by placing them into contact with the flat surface 75 of the magnetic attachment seat 70. The magnetic attraction between the magnetic attachment 90 and the magnetic attachment seat 70 holds the magnetic attachment 90 in place during the molding process. The magnetic attachments 90 may be permanent magnets tested to withstand elevated temperatures with minimal deterioration of magnetic properties over a substantial period of time. As shown in FIG. 2B, the magnetic attachment 90 may have a threaded stud 92 extending orthogonally from the main body 94 of the magnetic attachment 90. The main body 94 of the magnetic attachment 90 may be of varied shape and size and comprise a flat magnet surface 96 for abutting the flat surface 75 of the magnetic attachment seat 70. A nut 98 may be connected to the threaded stud 92 to anchor the permanent magnet in the brick assembly 1 when the mold material hardens in the mold chamber 52.

To manufacture the brick assemblies 1, the magnetic attachments 90 may be placed on the corresponding magnetic attachment seats 70 in each of the mold chambers 52. The mold material may be poured, filling the mold chambers 52 to a predetermined level. The mold material may set for a number of hours or until adequately hard. The finished brick assemblies 1 may be easily removed from the flexible mold 50 by hand or machine and allowed to further dry. The brick assemblies 1 may be painted and are ready for installation. By virtue of the planar surface created with magnetic attachments 90 embedded and anchored, the brick assemblies 1 may be magnetically secured to a metal firebox with efficiency, safety and stability.

Figure 3:
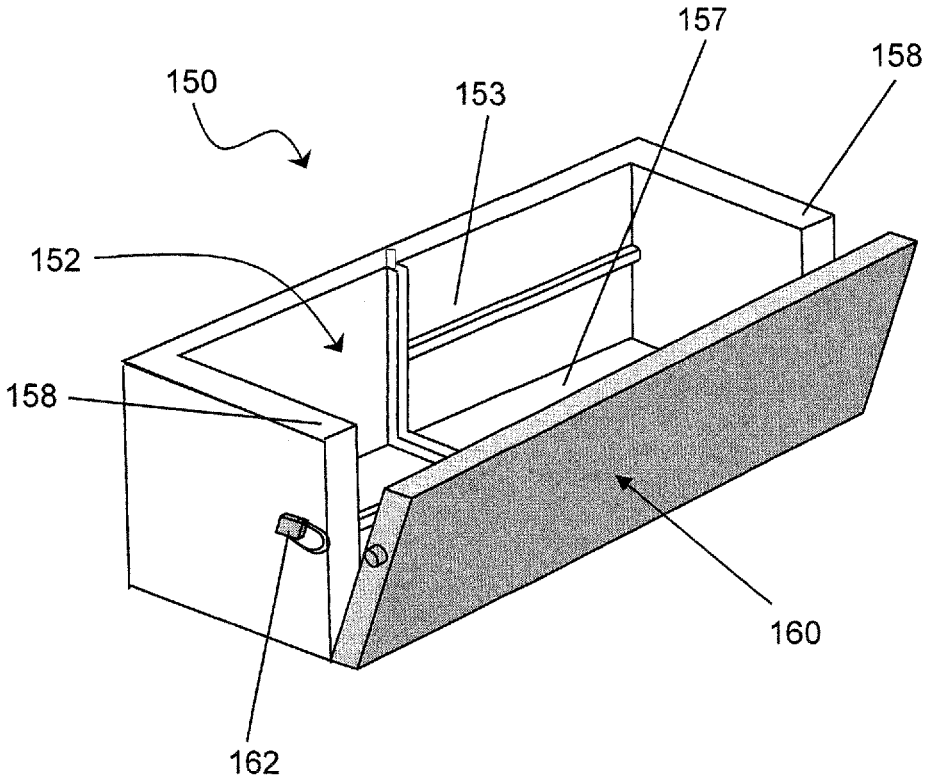
FIG. 3 illustrates a brick mold with a hinged metal door.
Figure 5:
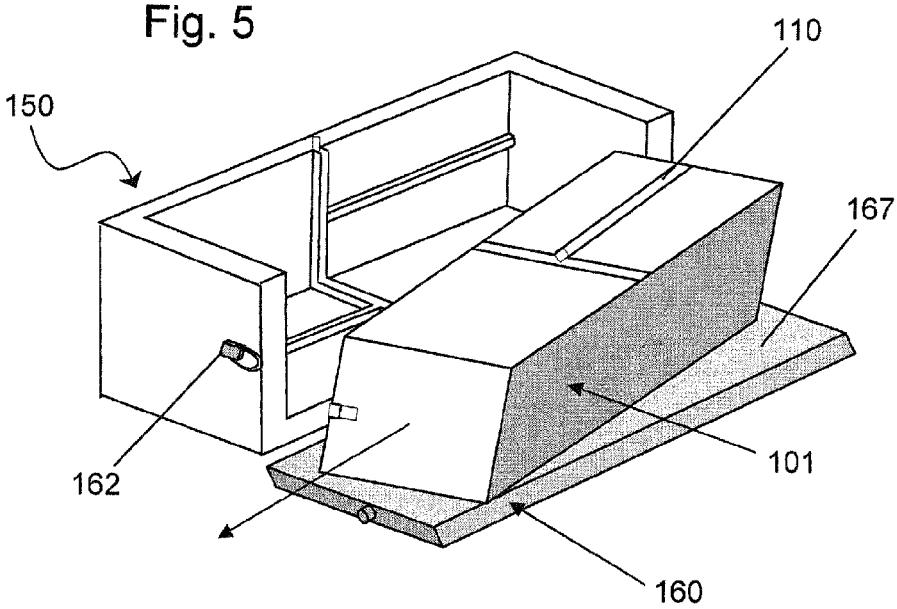
FIG. 5 illustrates a brick assembly with embedded magnetic attachments in position to be removed from the hinged metal door of the brick mold.

FIG. 3 shows another brick mold 150 to form bricks 101 (see FIG. 5). Brick mold 150 includes a mold chamber 152 and a hinged metal door 160. The mold chamber 152 may be a hollowed rectangular chamber open on an upper surface for pouring the mold material into the mold chamber 152. The mold chamber 152 may have textured surfaces 153 for creating the appearance of grout lines 110 (see FIG. 5), for example. The hinged metal door 160 may form a longitudinal side of the mold chamber 152. The hinged metal door 160 may be hinged to the lower surface 157 and abut the lateral ends 158 of the mold chamber 152 when in a closed position. A latch 162, for example, may be provided on at least an exterior surface of a lateral end 158 for securing the door 160 in a closed position during the molding process. Although a latch 162 is described, any other suitable means for securing the door 160 in a closed position may be used, including a strap, a magnet, or a spring loaded hinge, for example.

Figure 4:
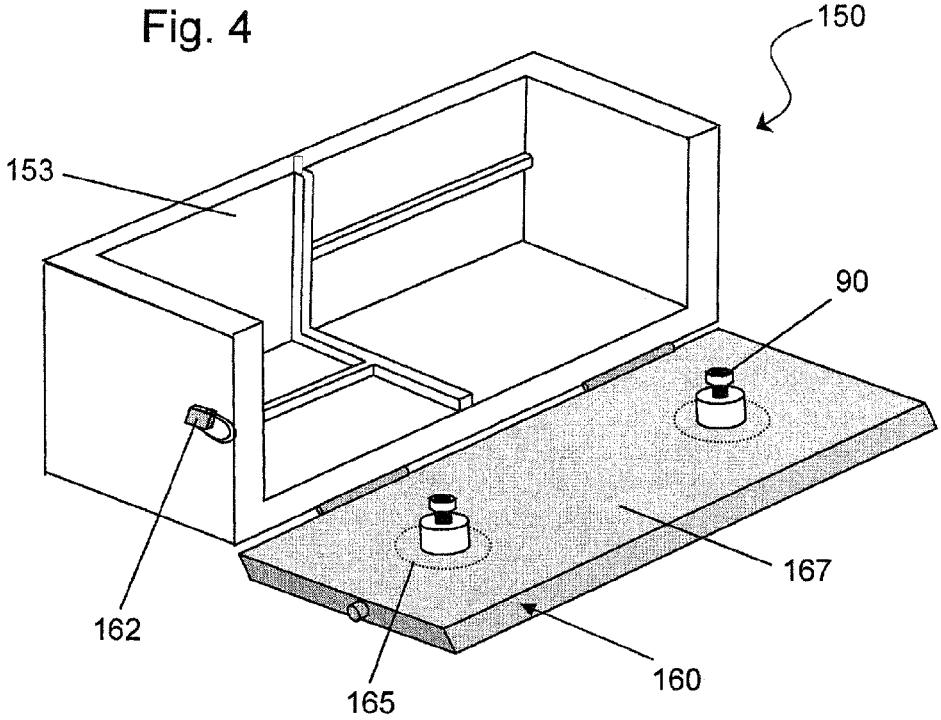
FIG. 4 illustrates the brick mold with the hinged metal door in an open position to reveal placement of magnetic attachments in positioning circles.

FIG. 4 shows the brick mold 150 with the hinged metal door 160 in an open position. The hinged metal door 160 may include position circles 165 etched or marked on a planar interior surface 167 of the hinged metal door 160. The interior surface 167 of the hinged metal door 160 may be flat and smooth to create a planar non-textured mold surface. Position circles 165 may form predetermined locations for the magnetic attachments 90 to be magnetically affixed to the hinged metal door 160.

The hinged metal door 160 may be closed and the latch 162 engaged to secure the door 160 in a closed position. Once the magnetic attachments 90 are positioned in circles 165, the mold material may be poured into the large mold chamber 152, filling the chamber to a predetermined level. The mold material may set for a predetermined period of time or until adequately hard for safe removal. The latch 162 may be released to allow the hinged metal door 160 to open. As shown in FIG. 5, because the magnetic attachments 90 are now embedded in the dried brick assembly 101, the brick assembly 101 adheres to the hinged metal door 160 when the hinged metal door 160 is allowed to open. The brick assembly 101 may be easily removed from the mold 150 by simply sliding the brick assembly 101 off of the hinged metal door 160. The magnetic attachments 90 are embedded and anchored in the brick assembly 101 along a smooth planar surface as a result of being molded right up against the planar interior surface 167 of the hinged metal door 160. The brick assembly 101 may continue to dry for a predetermined period of time and then painted in any various patterns to create a customizable aesthetic appeal.

Figure 6:
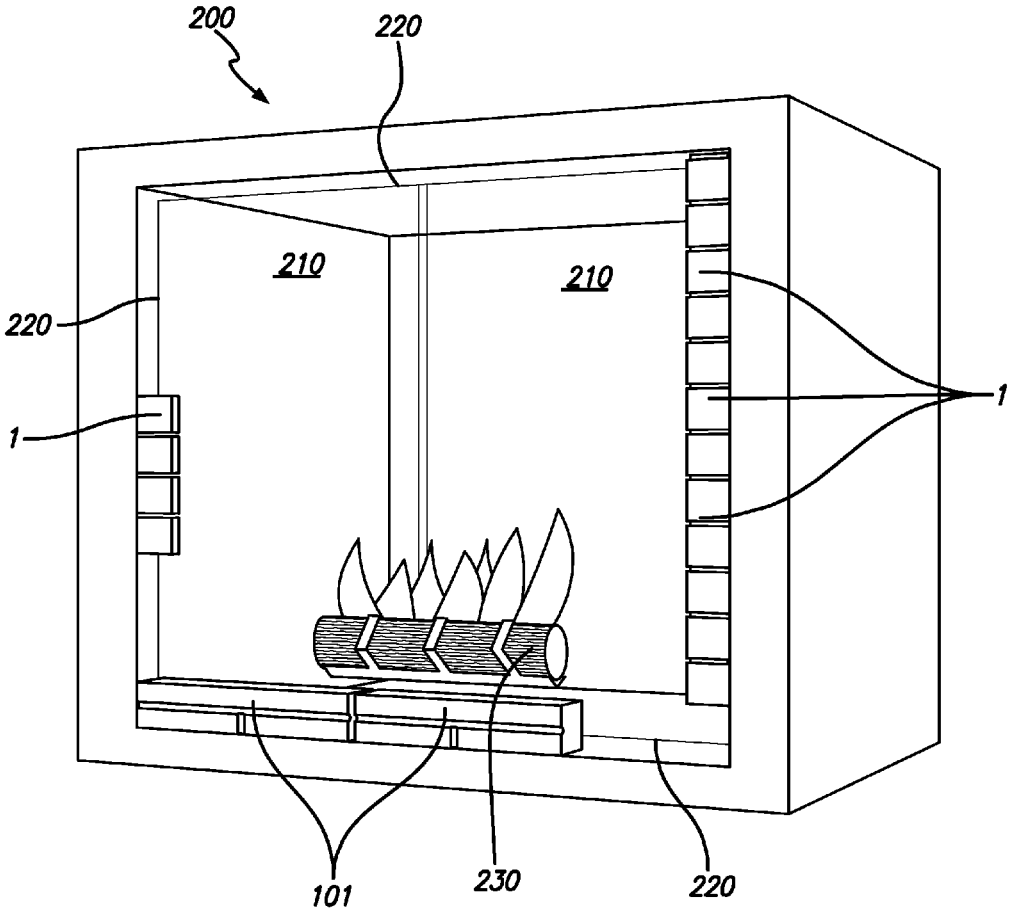
FIG. 6 illustrates a metal firebox assembly with glass door and brick assemblies magnetically secured to various surfaces of the metal firebox.

FIG. 6 shows a metal firebox assembly 200 which may have a glass door 210, for example. The firebox assembly 200 may have multiple glass doors, a single glass panel, be open or have a screen. The door 210 may have a perimeter connection 220 to the firebox assembly 200. The brick assemblies 1, 101 may be positioned in any configuration around the perimeter of the firebox assembly 200. A preferred embodiment is shown in FIG. 6 in which the bricks 101 may be placed horizontally along the bottom perimeter of the firebox assembly 200 opening. The brick assemblies 1 may be positioned vertically to run along the side wall perimeter of the firebox assembly 200. The brick assemblies 1, 101 are placed so that the textured surfaces are visible and the smooth planar surfaces with the magnetic attachments 90 are magnetically secured to the metal firebox assembly 200.

As shown in FIG. 6, a log set 230 may be installed into the firebox, for example. The glass door 210 may be closed and the brick assemblies 1, 101 safely and efficiently placed around the perimeter of the firebox opening to cover any exposed metal in front of the glass door 210. This creates a very clean look and feel to the firebox assembly 200 and permits easy installation and maintenance of the log set 230. The magnetic properties of the brick assemblies 1, 101 means that they may be placed, moved, removed or replaced with ease and without the need to use clips or other joining means.

The previous description is provided to enable any person skilled in the art to practice the full scope of the present invention. Various modifications to the embodiments described herein will be readily apparent to those skilled in the art, and the generic principles defined herein may be applied to other embodiments. Thus, the claims are not intended to be limited to the embodiments shown herein, but are to be accorded the full scope consistent with the language of the claims, wherein all structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A firebox assembly, comprising:

a firebox having an interior surface; and a brick assembly having an attachment surface, the brick assembly comprising:

at least one molded brick comprising a planar surface and at least one magnetic attachment embedded in the molded brick, the at least one magnetic attachment having an exterior planar surface, where the attachment surface consists essentially of the exterior planar surface of the magnetic attachment and the planar surface of the molded brick that abuts the interior surface of the firebox, wherein the embedded magnetic attachment magnetically secures the planar brick assembly surface to the interior surface of the firebox.

2. The firebox assembly of claim 1 further comprising a door having a perimeter connection to the firebox, wherein the at least one molded brick assembly magnetically secures to the interior surface to obscure from view the perimeter connection.

3. The firebox assembly of claim 1 further comprising a log set.

* * * * *